US010357789B2

(12) United States Patent
Camilleri et al.

(10) Patent No.: US 10,357,789 B2
(45) Date of Patent: Jul. 23, 2019

(54) PAINT RECEPTACLE COMPRISING A SUPPLE POUCH

(71) Applicants: Michel Camilleri, Souffelweyersheim (FR); Joseph Guarino, Mazan (FR)

(72) Inventors: Michel Camilleri, Souffelweyersheim (FR); Joseph Guarino, Mazan (FR)

( * ) Notice: Subject to any disclaimer, the term of this patent is extended or adjusted under 35 U.S.C. 154(b) by 0 days.

(21) Appl. No.: 15/976,114

(22) Filed: May 10, 2018

(65) Prior Publication Data

US 2018/0326435 A1 Nov. 15, 2018

(30) Foreign Application Priority Data

May 10, 2017 (FR) ..... 17 54077

(51) Int. Cl.

| | |
|---|---|
| ***B05B 7/02*** | (2006.01) |
| ***B05B 7/24*** | (2006.01) |
| ***B65D 77/06*** | (2006.01) |
| ***B65D 81/32*** | (2006.01) |

(52) U.S. Cl.

CPC ..... *B05B 7/24* (2013.01); *B05B 7/02* (2013.01); *B05B 7/2472* (2013.01); *B05B 7/2481* (2013.01); *B65D 77/06* (2013.01); *B65D 81/32* (2013.01); *B05B 7/2478* (2013.01)

(58) Field of Classification Search

CPC ..... B05B 7/02; B05B 7/2427; B05B 7/2481; B65D 77/06; B65D 81/32

USPC ..... 220/495.02

See application file for complete search history.

(56) References Cited

U.S. PATENT DOCUMENTS

| | | | | |
|---|---|---|---|---|
| 6,581,803 | B1 * | 6/2003 | Yoshimoto | B65D 83/0055 222/105 |
| 9,855,571 | B2 * | 1/2018 | Camilleri | B01F 15/00512 |
| 2015/0360248 | A1 * | 12/2015 | Camilleri | B01F 15/00512 206/221 |

FOREIGN PATENT DOCUMENTS

| | | | |
|---|---|---|---|
| DE | 202015003663 | U1 | 9/2016 |
| WO | WO-01/38194 | A1 | 5/2001 |
| WO | WO-2012/083310 | A2 | 6/2012 |
| WO | WO-2014/108606 | A1 | 7/2014 |

OTHER PUBLICATIONS

Search Report issued in French Patent Application No. 1754077 dated Jan. 4, 2018.

* cited by examiner

*Primary Examiner* — King M Chu
(74) *Attorney, Agent, or Firm* — Marshall, Gerstein & Borun LLP

(57) ABSTRACT

A receptacle to be fitted to a spraying tool includes an outer container, a contractible supple container housed within the outer container and containing a liquid component to be sprayed, and a removable closure member provided at the upper part of the outer container. The base of the supple container includes a locking member that is intended to protrude downwards from the underside of said base, through a through-hole provided within the base of the outer container. The receptacle also includes an immobilizing device in order to releasably lock the locking member, through said through-hole, such as to immobilize the supple container within the base of the outer container. The supple container may include at least one secondary removable container containing a product to be mixed with the liquid product contained within the supple container.

25 Claims, 6 Drawing Sheets

PAINT RECEPTACLE COMPRISING A SUPPLE POUCH

TECHNOLOGICAL FIELD

The present disclosure relates to the general technical field of receptacles containing sprayable liquids and spraying systems, apparatus or devices. These receptacles are generally used for packaging, preparation and working with a paint spray gun or for the spraying, storage, application and eventual conservation of a product originating from a mixture of at least two components. These receptacles are adapted to be fitted by means of an adapter assembly to a paint spray gun.

More particularly, the disclosure relates to a set or disposable kit comprising a supple and contractible container that can separately contain one or more components to be mixed together before being used.

BACKGROUND

In the domain of bi-component products and more generally multi-component paint products, to be propelled or sprayed, for example paints, primers, varnishes and other products, each of the two or more components of the final product must be packaged separately. The components are mixed at the last moment, just before being used, because after a certain amount of time it is no longer possible to propel or spray them, due for example to their assuming mass, going hard or becoming pasty. Furthermore, these components are generally sensitive to air and/or to light and must be separately packaged within sealed and/or opaque containers.

When a bi-component or multi-component product has to be sprayed, the operator must generally perform the premixing of the components of the product himself, before then transferring the mixture to a receptacle that is suitable for the spraying tool thereof, each of the components of the product being initially individually packaged within a separate container.

This preparation of sprayable bi-component or multi-component products presents numerous inconveniences, amongst which the following can be particularly cited:

- bulky and costly packaging for bi-component products because each of the components must be individually packaged within a separate container;
- risks of component or product inversion and loss during the preparation of the product to be sprayed due to multiple transfer operations from one recipient to another;
- risks of imprecise dosage on the part of the operator during the preparation of the product to be sprayed, which can negatively impact upon the effectiveness of the bi-component product obtained;
- cumbersome storage of partially emptied containers for each of the premixed components;
- deterioration in air of those remaining components stored within partially emptied containers;
- a preparation time for producing the mixture of the components that is too long, while the increasing cost of labor leads employers to find solutions for increasing the speed of work.

In the domain of painting, or of spraying by means of a gravity fed, suction fed or similar paint spray gun, there are very few single use bi-component packagings.

Furthermore, due to the technical complexity that such packaging represents, no packaging exists that comprises a supple and contractible container that is capable of separately containing one or more components to be mixed before being used. In effect, those packagings that make it possible to contain several components to be mixed before being used, within the same container, usually make use of at least one detachable rigid part that releases one or more components when it is removed. The presence of such detachable parts within a supple and contractible container poses a number of technical problems.

Amongst these technical problems, insofar as it is usually difficult to achieve a reliable seal between a supple container and an outer container, for example a rigid container, that of the seal between these detachable parts and the supple and contractible container can be cited.

Problems associated with the contractible nature of the supple container can also be cited, which is therefore intended to be capable of contracting in upon itself when the content thereof is withdrawn during the operation of the spraying tool. Thus, the supple contraction upon itself of the container requires freedom for the deformation thereof, particularly if it is required that it be entirely emptied of the contents thereof, and it is difficult for this freedom of deformation to be compatible with a reliable seal between the supple container and the detachable rigid parts

SUMMARY OF THE DISCLOSURE

The aim of the present disclosure is to provide a new working and packaging receptacle serving as a disposable cup for fitting to a spraying tool in such a way as to render painting or spraying work easier and quicker but also more economical in terms of products and materials.

A further object of the disclosed embodiments aims to provide packaging that is capable of containing, in a separate and reliable manner, one or more components to be mixed before being used.

The objects assigned to the disclosed embodiments are obtained by virtue of a receptacle to be fitted to a spraying tool, intended to contain at least one liquid painting, varnishing or cleaning product intended to be sprayed and comprising:

- an outer container comprising a base and at least one peripheral lateral wall extending from the base to an upper peripheral edge forming an open connection end that is spaced apart from and facing said base;
- a supple container, housed within the outer container and intended to contain at least one liquid component intended to be sprayed;

characterized in that it also comprises an immobilizing device intended to lock the supple container within the base of the outer container.

Thus, by virtue of the disclosed embodiments, it is advantageously possible to provide for a receptacle to be fitted to a spraying tool and comprising a supple container that can be maintained within the outer container by means, when necessary, of an immobilizing device, for example when spraying the contents thereof, in order to be able to freely contract upon itself and be entirely emptied, According to exemplary embodiment, the base of the outer container has a through-hole; the supple container comprises a base, the base of the supple container comprises a locking member that is attached to the supple container or formed integrally therewith as one piece; and the locking member is provided protruding from the outer face of the base of the supple container and extends through said through-hole.

The immobilizing device is preferentially provided on the underside of the base of the outer container in order to releasably lock the locking member. This makes it possible to releasably immobilize the supple container within the base of the outer container.

According to a further exemplary embodiment, the immobilizing device comprises an immobilization part fitted movable on the underside of the outer container at the through-hole thereof between a locked position wherein said immobilization part releasably locks the locking member in order to immobilize it, and an unlocked position wherein the immobilization part releases the locking member. The passage of the immobilization part from the locked position to the unlocked position, and vice versa, is performed, for example, by rotating or sliding said immobilization part.

According to an additional exemplary embodiment, the immobilizing device comprises an immobilizing part fitted removable on the underside of the outer container at the through-hole thereof, the immobilizing part locking the locking member in order to immobilize it when in situ, and releasing the locking member when it is removed. The implementation of the immobilizing part in the locked position of the locking member is performed, for example, by means of screwing, clipping or press-fitting.

These types of immobilizing device advantageously make it possible to quickly and easily lock or release the supple container within the base of the outer container.

According to an exemplary embodiment, the immobilizing part has horizontal arms extending laterally outwards and the base of the outer container has supplementary housing members on the underside of said base in order to receive the immobilizing part. This type of immobilizing device is easy to manufacture and has very satisfactory strength.

According to a further exemplary embodiment, the locking member comprises a flange protruding from the underside of the base of the outer container through the through-hole. This type of locking member is easy to manufacture and is for example similar to the flange forming the collar of balloons.

According to a further exemplary embodiment, the flange is immobilized by being clamped between the upper face of the immobilizing part and the underside of the base of the outer container when said immobilizing part locks the locking member. This immobilization takes advantage of the supple nature of the material of the supple container.

According to an additional exemplary embodiment, the upper face of the immobilizing part comprises a plate that comes into abutment with the underside of the flange, this plate having a support surface wherein the area thereof is greater than the area of the surface occupied by the flange. Due to the shape thereof, the plate makes it possible to clamp the entire surface of the flange, thereby perfectly immobilizing the supple container within the base of the outer container.

According to an exemplary embodiment, the supple container comprises a base and at least one peripheral lateral wall extending from the base to an upper peripheral edge forming an open connection end that is spaced apart from and facing said base.

According to a further exemplary embodiment, the upper peripheral edge of the supple container has a shoulder extending radially outwards. This shoulder advantageously makes it possible to place the upper peripheral edge of the supple container in contact with that of the outer container, and can also serve as a sealing abutment face for the removable closure member.

According to an exemplary embodiment, the supple container is bonded and/or heat sealed to the outer container.

According to a further exemplary embodiment, the shoulder of the supple container is bonded and/or heat sealed at the lower face thereof onto the top of the upper peripheral edge of the outer container which advantageously makes it possible to render the upper peripheral edge integral to that of the outer container.

According to an exemplary embodiment, the receptacle further comprises a removable closure member provided at the upper part of the outer container in order to close, in a sealed manner, both the connection end of the outer container and the connection end of the supple container.

According to a further exemplary embodiment, the closure member is a sealing film that is bonded and/or heat sealed onto the top of the upper peripheral edge of the outer container and/or the upper peripheral edge of the supple container.

According to an additional exemplary embodiment, the closure member is a lid that is screwed, clipped or press-fitted onto the upper peripheral edge of the outer container.

These different closure means make it possible to sealably close the receptacle. Once the closure member is removed it can easily be replaced by an adapter assembly in order to fit the receptacle to a spraying tool.

According to an exemplary embodiment, the supple container further comprises at least one secondary removable container intended to contain a liquid or sprayable product to be mixed with the contents of the supple container. This at least one secondary removable container advantageously makes it possible to spray a multi-component product.

According to a further exemplary embodiment:

the at least one secondary removable container comprises a peripheral lateral wall, extending from a peripheral lower edge forming an open lower connection end, to an upper peripheral edge forming an upper open connection end that is spaced apart from and facing said peripheral lower edge; and/or the supple container has at least one closure part on the upper face of the base thereof, formed integrally as one piece with the supple container or attached thereto, which closes in a sealed manner the open lower connection end of the at least one secondary removable container when said at least one secondary removable container is housed within the base of the supple container.

Thus, by virtue of the disclosed embodiments, it is advantageously possible to provide for at least one supplementary container fitted removable and sealed within the base of the supple container, this supplementary container can easily be withdrawn in order to mix the contents thereof with that of the supple container.

According to an additional exemplary embodiment, the closure member has at least one closure part on the underside, formed integrally as one piece with the closure member or attached thereto, which closes in a sealed manner the open lower connection end of the at least one secondary removable container when the removable closure member is provided at the upper part of the supple container. Thus, the closure member can close the secondary container at the upper part.

According to an exemplary embodiment, the closure member is a sealing film that is bonded and/or heat sealed onto the upper peripheral edge of the secondary container which makes it possible to sealably close the receptacle within the upper part thereof.

According to a further exemplary embodiment, at least one closure part amongst those of the removable closure member and of the supple container, is in the form of a plug that protrudes in order to penetrate and seal within the at least one secondary removable container, respectively through the peripheral upper or lower edge thereof. This type of closure part is easy to manufacture and ensures very satisfactory sealing with the at least one secondary removable container.

According to an additional exemplary embodiment, the at least one secondary removable container comprises a wedging device for maintaining it in a wedged position within the supple container. This wedging device advantageously makes it possible to maintain the at least one secondary removable container in a position within the supple container such that it will not accidentally move in relation to it and such that the closure parts will not mistakenly disengage.

According to an exemplary embodiment, the wedging device comprises wedging arms that extend radially outwards from the peripheral lateral wall of the at least one secondary container in order to wedge in abutment against the inner sides of the peripheral lateral wall of the supple container or against the peripheral lateral wall of an adjacent secondary container.

According to a further exemplary embodiment, the receptacle contains at least one liquid painting, varnishing or cleaning product intended to be sprayed.

BRIEF DESCRIPTION OF THE DRAWINGS

Other characteristics and advantages of the presently disclosed embodiments will be seen more clearly from the following description, provided with reference to the appended drawings, provided by way of non-limiting examples, in which.

DETAILED DESCRIPTION

Figure 1:
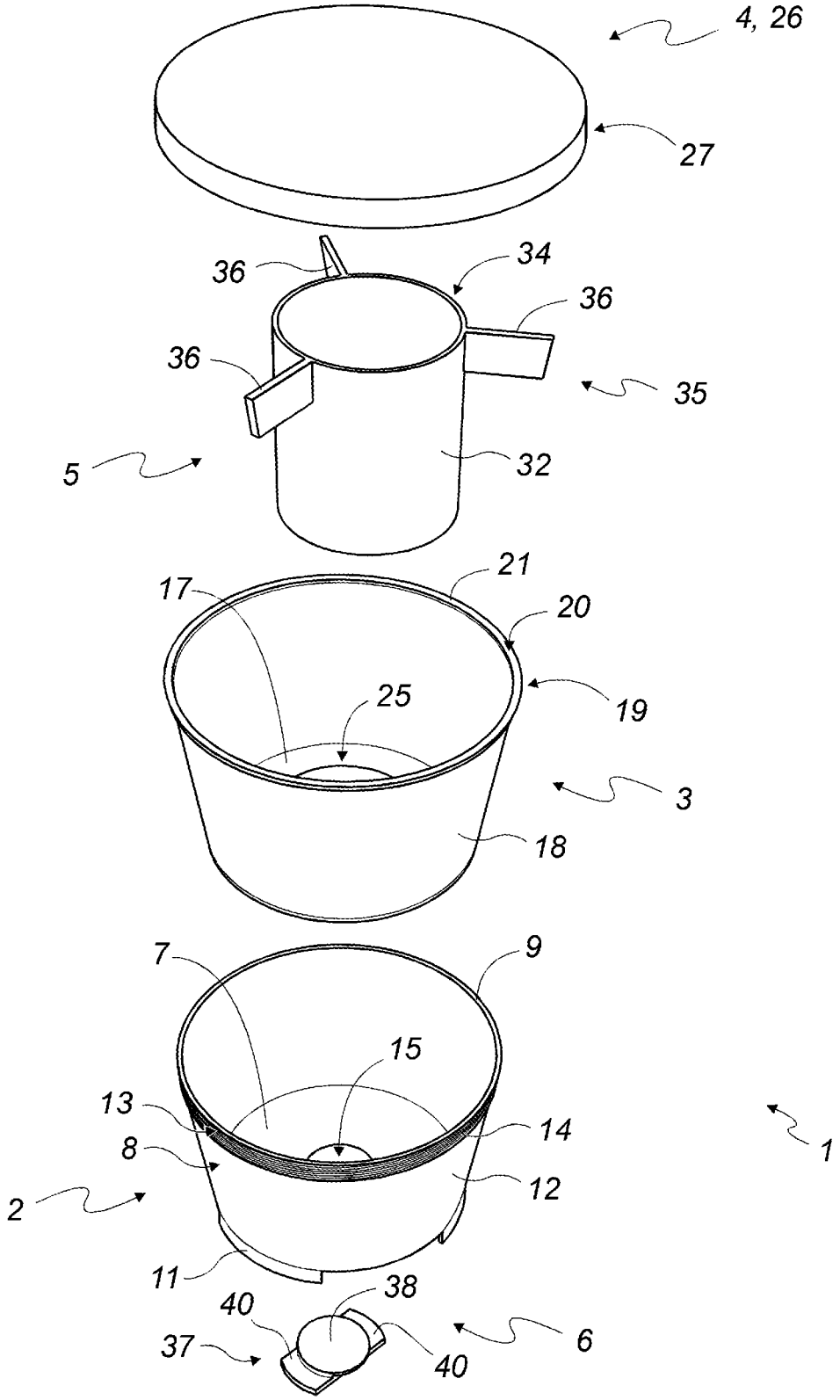
FIG. 1 is a perspective top view of a disposable receptacle according to a bi-component variant in the disassembled state.

The structurally and functionally identical elements shown in several different figures are assigned the same numerical or alphanumerical reference.

With upper or lower, reference will be made to the object of the disclosed embodiments as shown in the figures. It will be obvious to a person skilled in the art that the orientation adopted for the object of the disclosed embodiments in the figures will not necessarily be maintained in use.

Within the text the term sealed refers to a container that does not allow the liquid that it contains to pass under normal conditions of use for a person skilled in the field of manufacturing disposable paint cups for spraying paint, primers, varnishes and other similar products.

Similarly, for all of the other technical terms that the reader may consider to be ambiguous, reference should be made to the common significance thereof for a person skilled in the field of manufacturing disposable paint cups for spraying paint, primers, varnishes and other similar products.

The receptacle (1) according to the disclosed embodiments is intended to be fitted to a spraying tool and is intended to contain a liquid painting, varnishing or cleaning product intended to be sprayed.

It is preferably disposable and of a general substantially cylindrical or tapered shape.

The receptacle (1) comprises an outer container (2) wherein a supple container (3) is housed, the entirety being closed at the top by means of a removable closure member (4).

According to a preferred embodiment, the receptacle (1) further comprises at least one secondary removable container (5) intended to contain a liquid or sprayable product to be mixed with the contents within the supple container (3)

According to this preferred embodiment, the secondary removable container (5) is housed within the supple container (3) and an immobilizing device (6) is provided in order to maintain the supple container (3) within the base of the outer container (2).

Figure 2:
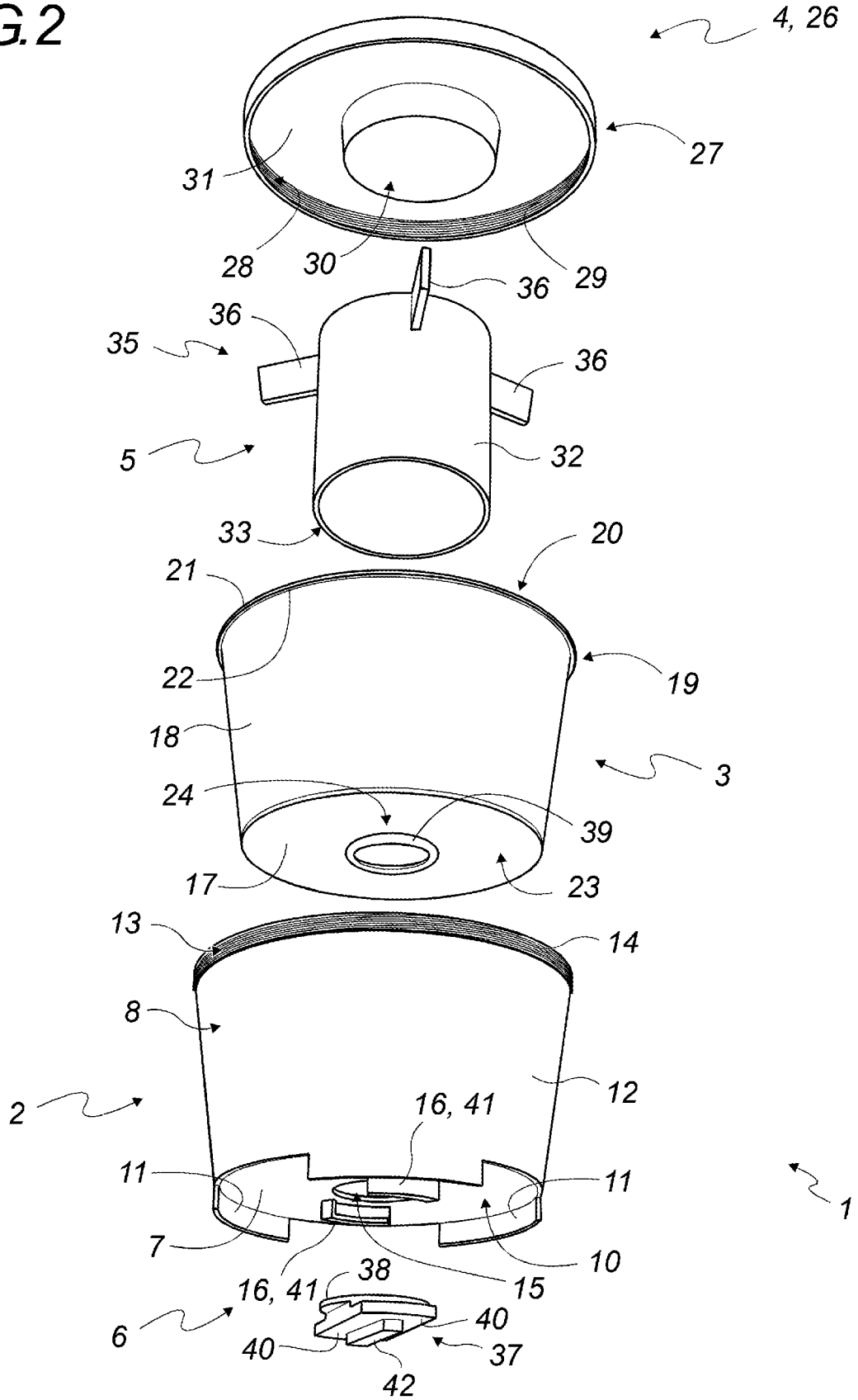
FIG. 2 is a perspective bottom view of a disposable receptacle according to a bi-component variant in the disassembled state.
Figure 3:
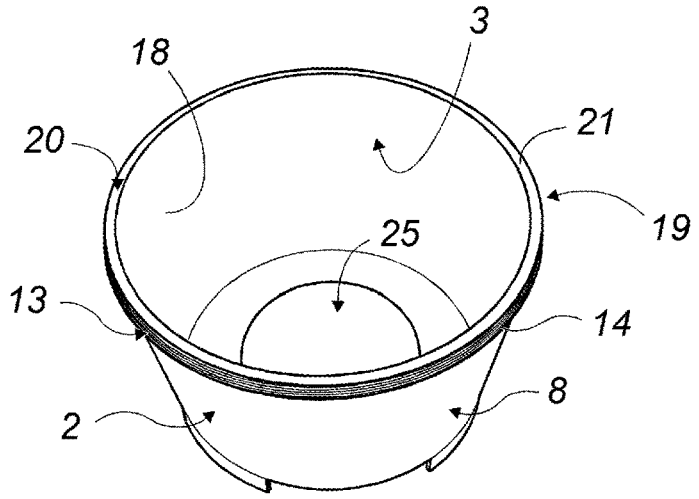
FIG. 3 is a perspective top view of a supple container housed within an outer container according to a bi-component variant.
Figure 4:
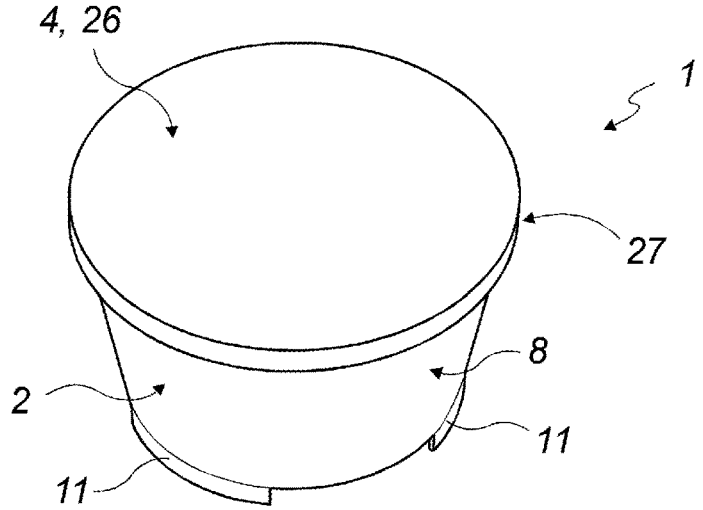
FIG. 4 is a perspective top view of a disposable receptacle according to a bi-component variant in the assembled state.
Figure 5:
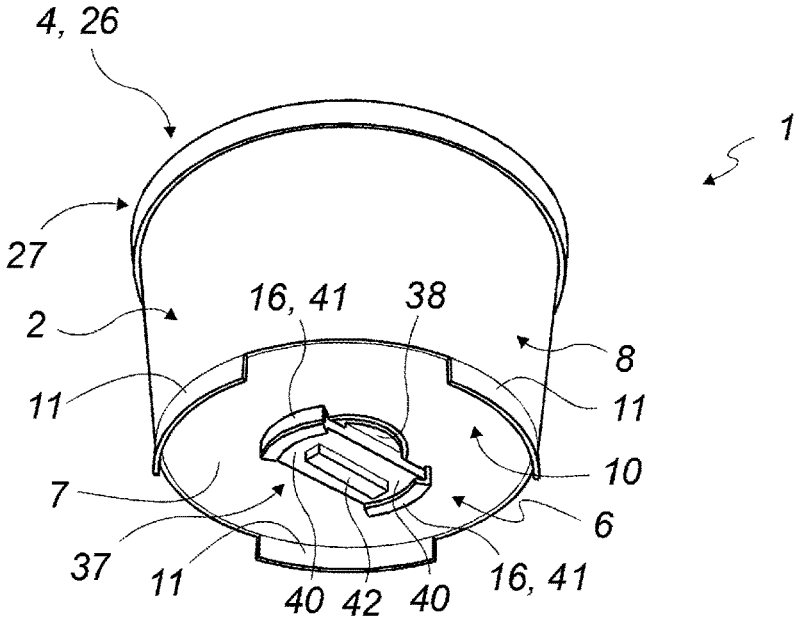
FIG. 5 is a perspective bottom view of a disposable receptacle according to a bi-component variant in the assembled state.
Figure 6:
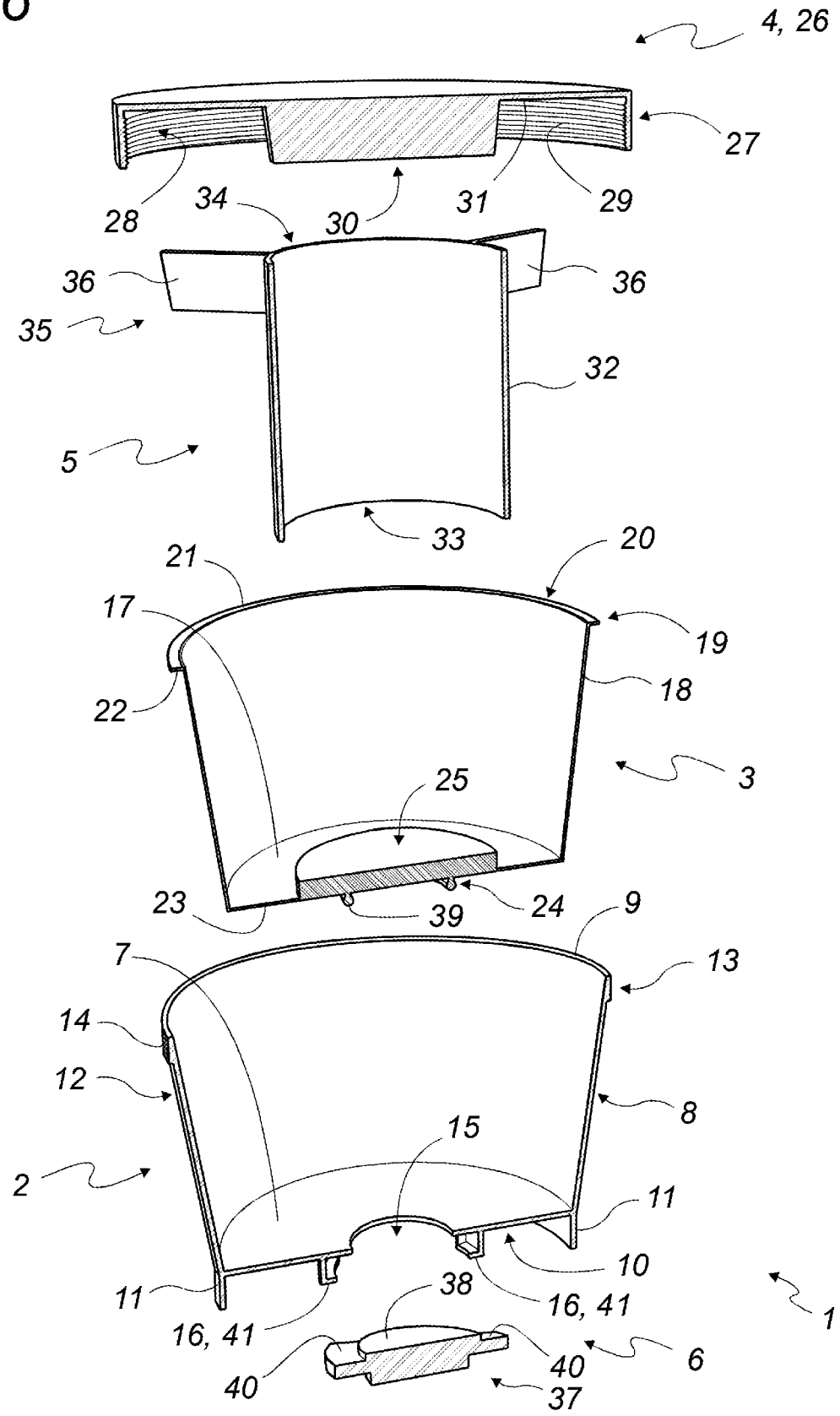
FIG. 6 is a vertical cross-section view of a disposable receptacle according to a single- or bi-component variant in the disassembled state.

These different embodiments are represented in the disassembles state according to a preferred variant in FIGS. 1, 2 and 6. They are represented in the assembled state in FIGS. 4, 5 and 7.

The outer container (2) comprises a base (7) and at least one peripheral lateral wall (8) extending from the base (7) to an upper peripheral edge (9) forming an open connection end that is spaced apart from and facing said base (7). This outer container (2) is usually designated as a "bowl", "pot" or "cup" for a person skilled in the field of disposable paint containers for spray painting.

It is preferably disposable and of a general substantially cylindrical or tapered shape.

On the underside (10) thereof, the outer container (2) preferentially comprises a support (11), for example in the form of at least a protruding edge extending the base (7) downwards, thereby making it possible to rest, in a stable manner, the outer container (2) upon a receiving surface and also making it possible to raise the base (7) by means of said receiving surface. This elevation thus forms a open volume located beneath the base (7) of the outer container (2) such that the immobilizing device (6), intended to be located at least partially on the underside of the outer container (2), does not project downwards beneath the outer container (2), which could lead to a lack of stability for said outer container (2).

On the outer face (12) of the peripheral lateral wall (8) thereof, and at the upper part thereof, the outer container (2) preferentially comprises a shoulder (13) extending radially outwards and is provided in order to ensure the locking of the removable closure member (4). In the preferred case where this locking is performed by means of screwing, this shoulder (13) has a thread (14) on the external lateral face thereof. This locking can also be performed by means of clipping or by any other know means.

The base (7) of the outer container (2) has a through-hole (15) which serves to maintain the supple container (3) within the outer container (2) by means of the immobilizing device (6). On the underside, the base (7) of the outer container (2) can also have projecting parts (16) forming parts of the immobilizing device (6), these projecting parts (16) having a height that is less than that of the support (11). This immobilizing device (6) will be described further on.

The outer container (2) is for example of a plastic material that is resistant to solvents and other aggressive products that are normally used by a person skilled in the art, and are preferably formed by molding. It has for example an average thickness of 0.5 to 2 millimeters.

The outer container (2) is preferentially a rigid container. Rigid, means that the outer container (2) is resistant to torsion and shear stresses, and does not bend when it undergoes those stresses encountered during the normal use thereof. The rigidity thereof is that which a person skilled in the art would expect for a container intended to be used when fitted to a spraying tool, such as for example a paint cup.

Indeed, one of the roles of the outer container (2), in addition to protecting the elements housed therein, is to give sufficient rigidity to the receptacle (1) particularly so that after the withdrawal of the removable closure member (4), an adapter can be attached to the outer container (2), preferably at the shoulder (13) thereof, in order to mount the receptacle (1) and to use it on a spraying tool.

The supple container (3), is intended to be housed within the outer container (2) and intended to contain at least one liquid component intended to be sprayed; This outer container (3) is usually designated as a "supple pouch" for a person skilled in the field of disposable paint containers for spray painting.

The supple container (3) comprises a base (17) and at least one peripheral lateral wall (18) extending from the base (17) to an upper peripheral edge (19) forming an open connection end that is spaced apart from and facing said base (17).

It is preferably disposable and of a general substantially cylindrical or tapered shape.

According to a preferred embodiment, the upper peripheral edge (9) of the outer container (2) and the upper peripheral edge (9) of the supple container (3) have a similar diameter, thereby making it possible for example to place the upper peripheral edge (9) of the outer container (2) in abutment upon the upper peripheral edge (19) of the supple container (3), this abutment having the potential to be sealed when these two upper peripheral edges (9, 19) are pressed together by the removable closure member (4), or when they are bonded together or otherwise attached to one another.

At the upper end of the peripheral lateral wall (18) thereof, the supple container (3) preferentially has a shoulder (20) extending radially outwards, for example in the form of a flat ring. This shoulder (20) has an upper face (21) and an underside (22). The underside (22) of the shoulder (20) is preferably intended to be welded, bonded or otherwise attached to the upper peripheral edge (9) of the outer container (2).

Figure 7:
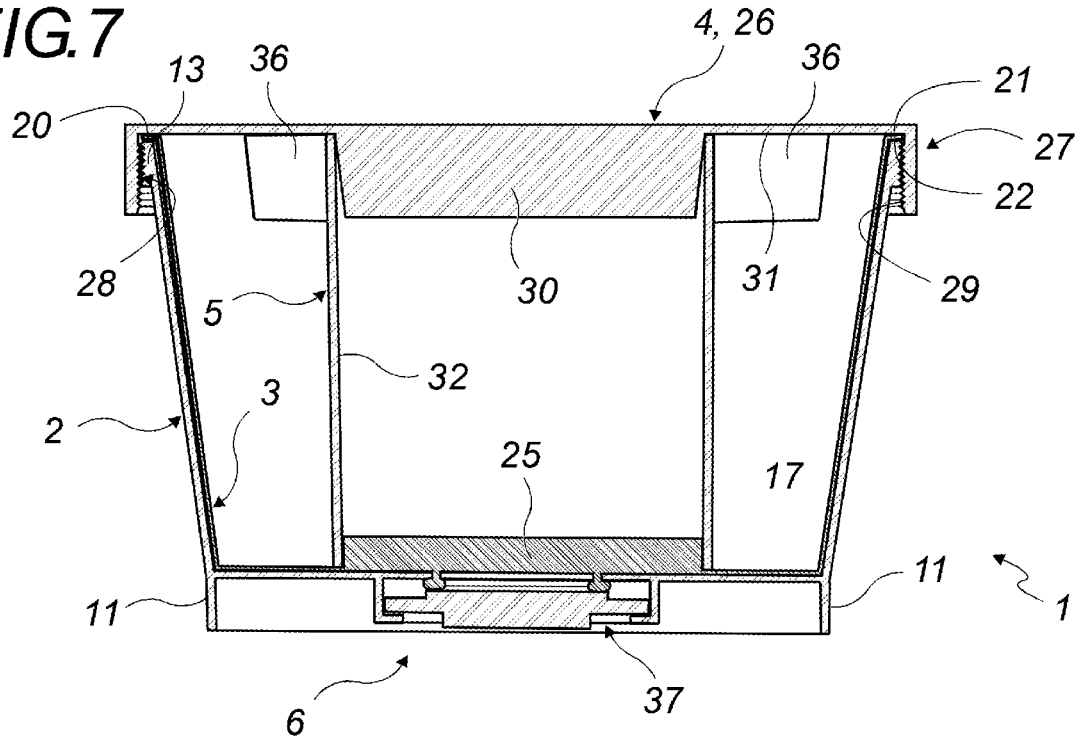
FIG. 7 is a vertical cross-section view of a disposable receptacle according to a bi-component variant in the assembled state.

It should also be noted that when the removable closure member (4) is fitted onto the outer container (2), the shoulder (20) is held tight between the underside (21) of said removable closure member (4) and the upper peripheral edge (9) of the outer container (2) (see FIG. 7). Thus, the upper peripheral edge (19) of the supple container (3) is closed, preferentially in a sealed manner, by means of the removable closure member (4).

On the underside (23) thereof, the base (17) of the supple container (3) comprises a locking member (24). This locking member (24) is attached to the supple container (3) or formed integrally as one piece therewith, and is intended to protrude outwards from the underside of the base (17).

The locking member (24) is intended to collaborate with at least one movable or removable part of the locking member (6) in order to hold the supple container (3) in a removable manner within the base (7) of the outer container (2), as will be explained further on.

According to a preferred embodiment, the base (17) of the supple container (3) comprises at least one closure part (25) on the upper face thereof, formed integrally as one piece with the supple container (3) or attached thereto.

Each closure part (25) of the supple container (3) is intended to plug, in a sealing manner, the lower end of a secondary container (5) housed, in a removable manner, within the base (17) of the supple container (3) as will be explained further on.

The supple container (3) is for example in a supple plastic material that is resistant to solvents and other aggressive products that are normally used by a person skilled in the art, and is preferably formed by molding, extrusion or blow-molding. It has for example an average thickness of 0.1 to 1.5 millimeters.

Supple, means that the supple container (3) is pliable and deforms easily, and that it is flexible. The supple container (3) is contractible and the suppleness thereof is that which a person skilled in the art would expect for a container intended to contain a liquid product and to retract upon itself when the content thereof is withdrawn during the operation of the spraying tool.

Indeed, the main role of the supple container (3) is to contain at least one liquid product to be sprayed and any possible secondary removable containers (5), and to allow for the extraction of the entirety of the liquid product contained therein by aspiration using the spraying tool.

The closure member (4) is intended to be fitted, in a removable manner, onto the receptacle (1) in such a way as to sealably close it at the top and to thus seal the upper peripheral edge (9) of the outer container (2) and the upper peripheral edge (19) of the supple container (3).

According to a first embodiment, the removable closure member (4) is a sealing film that is bonded and/or heat sealed to the supple container (3), which is itself bonded and/or heat sealed to the outer container (2). The sealing film can easily be removed by the user. According to this variant, the closure member (4) is similar to sealing films used in the food industry for sealing, for example, yogurt pots and trays of cooked dishes.

According to a preferred embodiment of this embodiment, the removable closure member (4) is a sealing film that is bonded and/or heat sealed to the upper peripheral edge (19) of the supple container (3), which is itself bonded and/or heat sealed to the upper peripheral edge (9) of the outer container (2).

According to a second embodiment, not shown in the figures, the closure member (4) is a sealing film that is bonded and/or heat sealed to the outer container (2), for example to the upper peripheral edge (9) thereof.

According to a third embodiment, not shown in the figures, the closure member (4) is a sealing film that is bonded and/or heat sealed both to the outer container (2) and to the supple container (3), for example to the upper peripheral edge (9, 19) thereof.

According to a fourth embodiment shown in the figures, the removable closure member (4) is a lid (26), preferably rigid, that is screwed, clipped or press-fitted onto the upper peripheral edge (9) of the outer container (2).

The closure member (4) preferentially comprises a peripheral rim (27) that extends vertically downwards and that is provided in order to ensure locking to the outer container (2).

In the preferred case where the locking of the closure member (4) on the receptacle (1) is performed by means of screwing, the inner face (28) of the peripheral rim (27) has a thread (29) that complements the thread (14) of the outer container (2).

Before mounting the receptacle (1) onto a spraying tool, this closure member (4) is intended to be removed manually and replaced by an adapter that acts as an interface between the receptacle (1) and the spraying tool, as is known to a person skilled in the art.

According to a preferred embodiment, the removable closure member (4) has at least one closure part (30) formed as a single part with the underside (31) of the closure member (4) or integral thereto.

Each closure part (30) of the closure member (4) is intended to plug, in a sealed manner, the upper end of a secondary container (5) housed, in a removable manner, within the base of the supple container (3) as will be explained further on.

When it is in the form of a lid (26), the closure member (4) is for example of a plastic material and preferably formed by molding. It has for example an average thickness of 1 to 3 millimeters.

When it is in the form of a sealing film, the closure member (4) is for example of a metal or plastic material. It has for example an average thickness of 0.05 to 0.5 millimeters.

As previously mentioned, according to a preferred embodiment, the receptacle (1) comprises at least one secondary container (5) intended to contain a liquid or sprayable product to be mixed with the liquid contents within the supple container (3). Each secondary container (5) is housed, in a removable manner, within the supple container (3).

Figure 8:
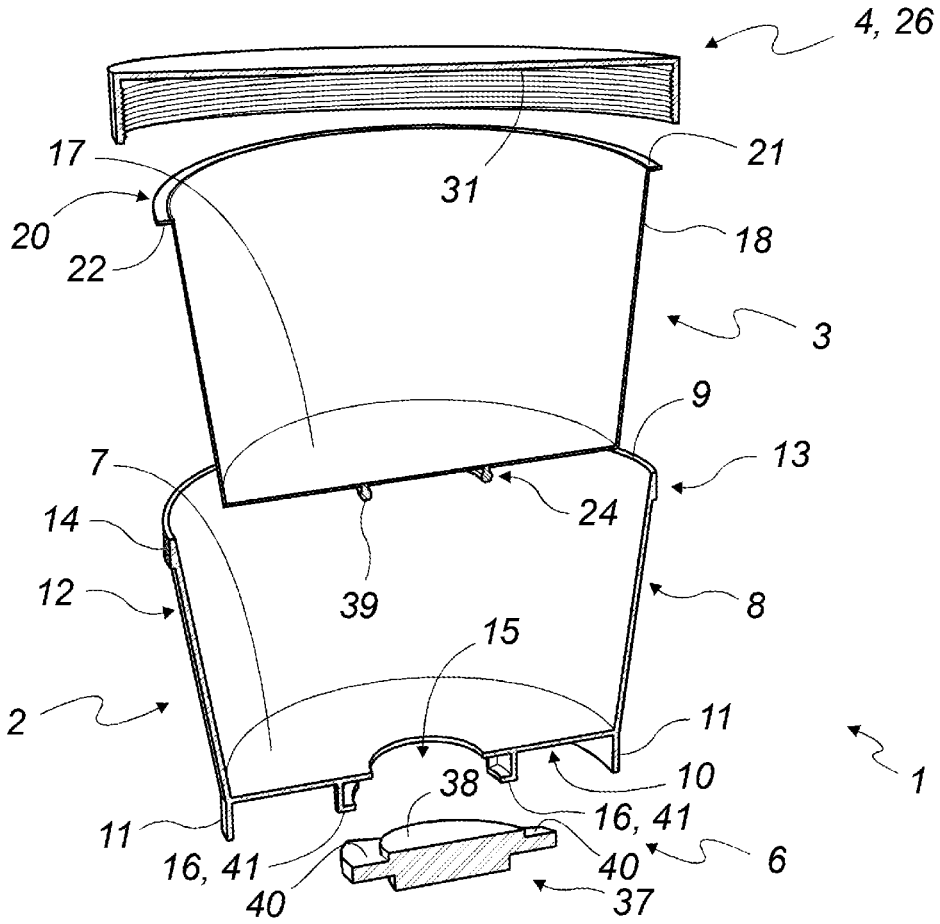
FIG. 8 is a vertical cross-section view of a disposable receptacle according to a single-component variant in the disassembled state.

This secondary container (5) is not necessary when the receptacle (1) is intended to contain only a single-component sprayable product. It can therefore be omitted, as shown in FIG. 8. As a result, due to the lack of a secondary container (5), the supple compartment (3) and closure member (4) represented in FIG. 8 do not comprise a closure part.

The presence of at least one secondary container (5) is necessary when the receptacle (1) is intended to contain a bi-component or multi-component sprayable product.

In this case, the supple container (3) contains a liquid product, whereas each secondary container (5) contains a liquid or powder additive that is intended to be mixed with the liquid product within the supple container (3) before being sprayed.

Each secondary removable container (5) comprises a peripheral lateral wall (32), extending from a peripheral lower edge (33) forming an open lower connection end, to an upper peripheral edge (34) forming an upper open connection end that is spaced apart from and facing said peripheral lower edge (33).

The upper peripheral edge (34) of each secondary container (5) is intended to be tightly sealed by means of a closure part (30) of the closure member (4), whereas the lower peripheral edge (33) of each secondary container (5) is intended to be tightly sealed by means of a closure part (25) of the supple container (3).

According to a preferred embodiment each closure part (25, 30) can be in the form of a protruding plug.

A "bi-component" embodiment is represented in FIGS. 1 to 7, where the receptacle (1) comprises only one secondary container (5). With these variants, each closure part (25, 30) is in the form of a single plug.

Figure 9:
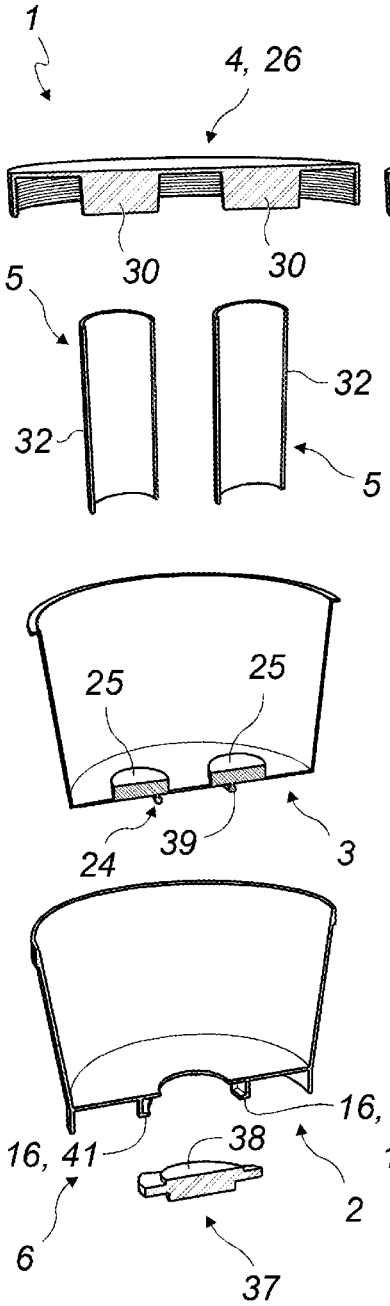
FIG. 9 is a vertical cross-section view of a disposable receptacle according to a multi-component variant in the disassembled state.
Figure 10:
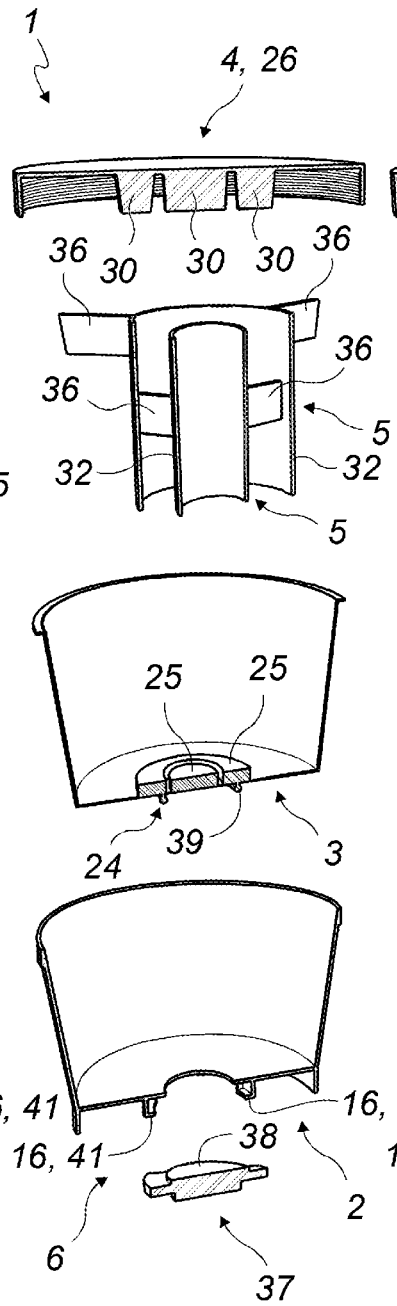
FIG. 10 is a vertical cross-section view of a disposable receptacle according to a further multi-component variant in the disassembled state.
Figure 11:
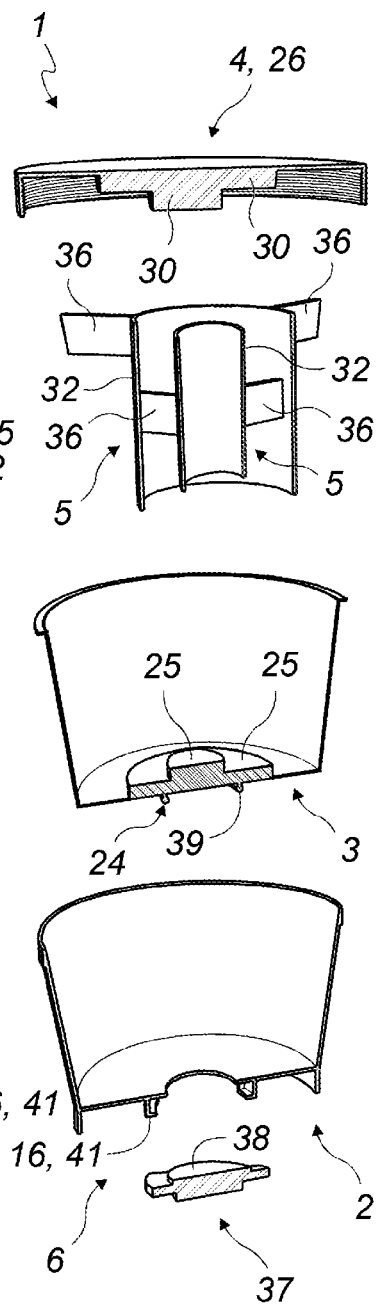
FIG. 11 is a vertical cross-section view of a disposable receptacle according to a further supplementary multi-component variant in the disassembled state.

A "multi-component" embodiment is represented in FIGS. 9 to 11, where the receptacle (1) comprises a plurality of secondary containers (5).

In the variant represented in FIG. 9, the closure member (4) and the supple container (3) each comprise several closure parts (25, 30) arranged next to one another for receiving and sealing several secondary containers (5) intended to be arranged next to one another.

In the variant represented in FIG. 10, the closure member (4) and the supple container (3) each comprise several closure parts (25, 30) arranged concentrically for receiving and sealing several secondary containers (5) intended to be arranged one inside the other and with a substantially similar height.

In the variant represented in FIG. 11, the closure member (4) and the supple container (3) each comprise several closure parts (25, 30) arranged in tiers for receiving and sealing several secondary containers (5) intended to be arranged one inside the other with decreasing size in the manner of nested dolls.

Obviously, a person skilled in the art can consider other ways of providing for the closure parts (25, 30) for receiving and sealing several secondary containers (5).

According to a preferred embodiment, each secondary removable container (5) comprises a wedging device (35) for maintaining it in a wedged position within the supple container (3). This wedging device (35) may for example be in the form of wedging arms (36), for example horizontal, extending radially outwards from the peripheral lateral wall of the secondary container (5), and wherein the free ends come to abut against the adjacent parts. In the case where the receptacle (1) only comprises one removable secondary container (5), these wedging arms (36) are intended to come to wedge in abutment against the inner face of the peripheral lateral wall (8) of the outer container (2), by means of the peripheral lateral wall (18) of the supple container (3). In the case where the receptacle (1) comprises several concentric secondary containers (5), the wedging arms (36) of the outermost secondary container (5) comes to wedge in abutment against the inner surface of the peripheral lateral wall (8) of the outer container (2), by means of the peripheral lateral wall (18) of the supple container (3), whilst the wedging arms (36) of the other secondary containers (5) come to wedge in abutment against the inner face of the peripheral lateral wall (32) of the immediately adjacent secondary container (5) within which it is housed.

Before mixing the different components to be sprayed, the closure member (4) should first be removed, it will then be the turn of each secondary container (5) to be extracted from the supple container (3). This extraction can be performed in an automatic manner if the closure part (30) of the closure member (4) is very tightly fitted within the peripheral upper edge (34) of the secondary container (5). In this case, when the closure member (4) is removed, the secondary container (5) remains attached to said closure member (4) and is removed at the same time.

When each secondary container (5) is extracted from the supple container (3), the content thereof mingles with that of the supple container (3) and they can be mixed until homogenization of the liquid to be sprayed is obtained.

During the withdrawal of the secondary containers (5) in order to mix the different components to be sprayed, this operation may subject the closure parts (25) to a vertical force which could lead to the upward displacement of the supple container (3). It is, however, desirable that the supple container (3) remain in position within the outer container (2). It is for this purpose that the receptacle (1) comprises an immobilizing device (6).

The purpose of said immobilizing device (6) is to hold the supple container (3) in position within the base of the outer container (2), particularly when the secondary containers (5) are withdrawn from the supple container (3).

According to a preferred embodiment, the immobilizing device (6) comprises an immobilizing part (37) which is fitted, in a removable or movable manner, to the underside of the outer container (2) at the through-hole (15) thereof, between a locked position wherein it locks the closure member (24) of the supple container (3) in order to prevent the removal thereof from the outer container (2), and an unlocked position wherein it releases the locking member (24) and wherein the supple container (3) can be extracted from the outer container (2).

For this purpose, the base (17) of the supple container (3) comprises a locking member (24) that is intended to protrude downwards from the underside of the base (17), through the through-hole (15) provided in the base (7), of the outer container (2) in order to cooperate with the immobilizing part (37).

According to a preferred embodiment, the immobilizing device (6) also comprises protruding parts (16) provided on the underside of the base (7) of the outer container (2) in order to hold the immobilizing part (37) in the locked position thereof.

According to the embodiment shown in FIGS. 1, 2, 5, and 6 to 11, the immobilizing part (37) is in the form of a removable plug comprising a plate (38) that is intended to abut in a locking manner against the locking member (24), which comprises a flange (39). The plate (38) and the flange (39) are preferentially circular. The plate (38) has a support surface wherein the area is greater than the area of the surface occupied by the flange (39) in such a way as to be able to fully press against said flange (39).

According to this variant, the immobilizing part (37) comprises horizontal arms (40) extending laterally outwards, engaging with the protruding parts (16) of the outer container (2) in the form of supplementary housing members (41) for restraining and locking. The restraint and locking of the immobilization part (37) within the supplementary housing members (41) is performed for example by rotating it by a quarter of a turn. In this case, the horizontal arms (40) have convex curved ends whereas the supplementary housing members (41) each have an overall concave curved shape.

On the underside, the immobilizing part (37) can also comprise a gripper (42) that protrudes downwards and that makes it possible to manually perform a quarter of a turn in order to lock or unlock the immobilizing part (37) within the supplementary housing members (41).

The function of the immobilizing device (6) according to this variant is clear from the sectional view of FIG. 7. When the immobilizing part (37) is engaged within the curves of the supplementary housing members (41) and then rotated by a quarter of a turn in order to be placed in the locked position, the plate (38) thereof abuts against the flange (39) of the locking member (24). This flange (39) is then immobilized by being wedged between the upper face of the immobilizing part (37) and the underside of the base of the outer container (2). The flange (39) is thus locked, and for example deformed in an elastic manner, by the plate (38), which prevents the withdrawal of the supple container (3) from the outer container (2).

When the supple container (3) is to be withdrawn from the outer container (2), it is sufficient to counter rotate the immobilizing part (37) by a quarter of a turn, and then withdraw it from the housing members (41).

The immobilizing part (37) can be removable, in order to release the locking member (24) when it is removed. It can also simply be movable, for example by rotation or sliding, between two extreme positions within which it either immobilizes the locking member (24), or releases it.

In an example of a embodiment where the locking member (24) is movable but not removable, the back thereof can remain in place within the housing members (41) which can either pivot one way or the other. A ramp provided within the housing members (41) then allows the plate (38) to be pressed against the flange (39) when the locking member (24) is rotated in one direction, or to release the flange (39) when the locking member (24) is rotated in the other direction.

In the case where the locking member (24) is removable, it can, for example, be implemented by being turned a quarter of a turn, as in the examples shown in the drawings, but it can also be implemented by screwing, clipping, press-fitting, or any other similar means.

In the same way, the immobilizing device (6) can take numerous other forms. In the embodiment shown in FIGS. 1, 2, 5, and 6 to 11, the immobilizing part (37) collaborates with the locking member (24) by means of clamping, but other variants can also be provided for wherein two parts cooperate through the through-hole (15) for example by clipping, by screwing or by press-fitting.

It is evident that the present description is not limited to the examples explicitly described, but that it also comprises other embodiments and/or implementations. Thus, a technical characteristic described herein can be replaced by an equivalent technical characteristic without going beyond the scope of the present disclosure or of the attached claims.

The invention claimed is:

1. A receptacle to be fitted to a spraying tool, intended to contain at least one liquid painting, varnishing or cleaning product intended to be sprayed and comprising:

an outer container comprising a base and at least one peripheral lateral wall extending from the base to an upper peripheral edge forming an open connection end that is spaced apart from and facing said base;

a supple container, housed within the outer container and intended to contain at least one liquid component intended to be sprayed;

wherein:

the base of the outer container has a through-hole;

the supple container comprises a base;

the base of the supple container comprises a locking member which is attached to the supple container or formed integrally as one piece therewith; and the locking member is provided protruding from the outer face of the base of the supple container and extends through said through-hole, and further wherein the receptacle also comprises an immobilizing device that locks the supple container within the base of the outer container, the immobilizing device comprising an immobilizing part that can be moved between a locked position wherein said immobilizing part releasably locks the locking member in order to immobilize the locking member, and an unlocked position wherein the immobilizing part releases the locking member.

2. A receptacle according to claim 1, wherein the immobilizing device is provided on the underside of the base of the outer container in order to releasably lock the locking member.

3. A receptacle according to claim 1, wherein the immobilizing part is fitted movable on the underside of the outer container at the through-hole thereof.

4. A receptacle according to claim 1, wherein the passage of the immobilizing part from the locked position to the unlocked position, and vice versa, is performed by rotating or sliding said immobilizing part.

5. A receptacle according to claim 1, wherein the immobilizing part is fitted removably on the underside of the outer container at the through-hole thereof, the immobilizing part locking the locking member in order to immobilize the locking member when in situ, and releasing the locking member when the immobilizing part is removed.

6. A receptacle according to claim 1, wherein the implementation of the immobilizing part in the locked position of the locking member is performed by means of screwing, clipping or press-fitting.

7. A receptacle according to claim 1, wherein the immobilizing part has horizontal arms extending laterally outwards and in that the base of the outer container has supplementary housing members on the underside of said base in order to receive the immobilizing part.

8. A receptacle according to claim 1, wherein the locking member comprises a flange protruding from the underside of the base of the outer container through the through-hole.

9. A receptacle according to claim 8, wherein the flange is immobilized by being clamped between the upper face of the immobilizing part and the underside of the base of the outer container when said immobilizing part locks the locking member.

10. A receptacle according to claim 9, wherein the upper face of the immobilizing part comprises a plate that comes into contact with the underside of the flange, this plate having a support surface wherein the area thereof is greater than the area of the surface occupied by the flange.

11. A receptacle according to claim 1, wherein the supple container comprises at least one peripheral lateral wall extending from the base of the supple container to an upper peripheral edge forming an open connection end that is spaced apart from and facing said base.

12. A receptacle according to claim 11, wherein the upper peripheral edge of the supple container has a shoulder extending radially outwards.

13. A receptacle according to claim 1, wherein the supple container is bonded and/or heat sealed to the outer container.

14. A receptacle according to claim 12, wherein the shoulder of the supple container is bonded and/or heat sealed at the lower face thereof onto the top of the upper peripheral edge of the outer container.

15. A receptacle according to claim 11, further comprising a removable closure member provided at the upper part of the outer container in order to close, in a sealed manner, both the connection end of the outer container and the connection end of the supple container.

16. A receptacle according to claim 15, wherein the closure member is a sealing film that is bonded and/or heat sealed onto the top of the upper peripheral edge of the outer container and/or the upper peripheral edge of the supple container.

17. A receptacle according to claim 15, wherein the closure member is a lid that is screwed, clipped or press-fitted onto the upper peripheral edge of the outer container.

18. A receptacle according to claim 1, wherein the supple container further comprises at least one secondary removable container intended to contain a liquid or sprayable product to be mixed with the contents of the supple container.

19. A receptacle according to claim 18, wherein:

the at least one secondary removable container comprises a peripheral lateral wall, extending from a peripheral lower edge forming an open lower connection end, to an upper peripheral edge forming an upper open connection end that is spaced apart from and facing said peripheral lower edge; and/or the supple container has at least one closure part on the upper face of the base thereof, formed integrally as one piece with the supple container or attached thereto, which closes, in a sealed manner, the open lower connection end of the at least one secondary removable container when said at least one secondary removable container is housed within the base of the supple container.

20. A receptacle according to claim 15, wherein the closure member has at least one closure part on the underside, formed integrally as one piece with the closure member or attached thereto, which closes, in a sealed manner, the open upper connection end of the at least one secondary removable container when the removable closure member is provided at the upper part of the outer container.

21. A receptacle according to claim 15, wherein the closure member is a sealing film that is bonded and/or heat sealed onto the upper peripheral edge of the secondary container.

22. A receptacle according to claim 19, wherein at least one closure part amongst those of the removable closure member and of the supple container, is in the form of a plug that protrudes in order to penetrate and seal within the at least one secondary removable container, respectively through the peripheral upper or lower edge thereof.

23. A receptacle according to claim 18, wherein the at least one secondary removable container comprises a wedging device for maintaining the at least one secondary removable container in a wedged position within the supple container.

24. A receptacle according to claim 23, wherein the wedging device comprises wedging arms that extend radially outwards from the peripheral lateral wall of the at least one secondary container in order to wedge an abutment against the inner sides of the peripheral lateral wall of the supple container or against the peripheral lateral wall of an adjacent secondary container.

25. A receptacle according to claim 1, wherein the receptacle contains at least one liquid painting, varnishing or cleaning product intended to be sprayed.

* * * * *